United States Patent [19]

Abe

[11] 3,952,183

[45] Apr. 20, 1976

[54] SHEET COUNTING APPARATUS

[75] Inventor: Masahiro Abe, Himeji, Japan

[73] Assignee: Glory Kogyo Kabushiki Kaisha, Himeji, Japan

[22] Filed: June 21, 1974

[21] Appl. No.: 481,908

[30] Foreign Application Priority Data

June 28, 1973 Japan ..... 48-72248
Oct. 31, 1973 Japan ..... 48-122595

[52] U.S. Cl. ..... 235/92 SB; 271/4; 271/119; 271/120; 271/149; 271/212; 271/224

[51] Int. Cl.[2] ..... G06M 9/00; B65H 3/02

[58] Field of Search ..... 235/92 SB, 98 R, 98 B; 194/DIG. 9 B; 271/4, 119, 178, 179, 212, 223, 224

[56] References Cited

UNITED STATES PATENTS

| | | | |
|---|---|---|---|
| 3,212,774 | 10/1965 | Ingalls | 271/212 |
| 3,214,096 | 10/1965 | Buchholz et al. | 235/98 R |
| 3,396,966 | 8/1968 | Solheim | 271/212 |
| 3,533,620 | 10/1970 | Vasse | 271/212 |
| 3,582,618 | 6/1971 | Bergman et al. | 235/92 SB |

FOREIGN PATENTS OR APPLICATIONS

| | | | |
|---|---|---|---|
| 670,112 | 3/1966 | Belgium | 271/4 |

*Primary Examiner*—Kathleen H. Claffy
*Assistant Examiner*—George G. Stellar
*Attorney, Agent, or Firm*—Wenderoth, Lind & Ponack

[57] ABSTRACT

A neat arrangement such as a pack of bills or like sheets to be counted is placed on one of their longitudinal edges in a sheet stand formed on the top of the casing of a sheet counting apparatus. An infeed mechanism comprising first and second infeed rolls frictionally feed the sheets one by one into the apparatus. A pair of sensing rolls are mounted under the second infeed rolls for sensing the passage thereover of each sheet thus fed into the apparatus and hence for actuating a counter switch. The thus counted sheets are successively loaded on a conveyor mechanism at one end thereof and are thereby transported toward the other end, where the successive counted sheets are stacked for recovery purposes. The apparatus further comprises an adjusting mechanism for adjusting the position of the sheets in the sheet stand and in the recovery mechanism according to their size and a stop motion mechanism for instantly terminating the infeeding operation of the sheets.

8 Claims, 12 Drawing Figures

SHEET COUNTING APPARATUS

BACKGROUND OF THE INVENTION

This invention relates to apparatus for counting bills, bank notes, security papers, cards, or like sheets of paper (hereinafter generally referred to as "sheets").

Sheet counting apparatus of the type now under consideration usually comprises a sheet stand for holding a neat pack of sheets to be counted, and an infeed mechanism for feeding, either frictionally or by suction, successive sheets to the next stage in the apparatus. The sheets thus supplied into the apparatus are counted before they are transported to a prescribed recovery position. The suction-type infeed mechanism, usually employing a movable suction head mounted opposite to the sheet stand, is disadvantageous in that it makes the overall apparatus inconveniently bulky and complex in construction because there must be incorporated therein a vacuum pump or the like communicating with the suction head and a mechanism for causing the desired intricate movement of the suction head.

The friction-type infeed mechanism, utilizing one or more rolls rotatably mounted for frictional circumferential contact with the foremost one of the sheets in the sheet stand, can make the sheet counting apparatus far simpler and less expensive in construction. However, this type of apparatus tends also to become bulky in size because the counting and some other constituent mechanisms of the apparatus are arranged along the path of travel of the successive sheets from the sheet stand to the recovery mechanism. In order to minimize the size of the apparatus, the counting and like mechanisms should be positioned as close as possible to the sheet stand.

Another problem accompanying the prior art sheet counting apparatus concerns its counting mechanism which heretofore has utilized either a phototube or microswitch. The service life of the phototube-type counting mechanism is significantly reduced if the spacings between the successive sheets traveling past the phototube are irregular, because such irregularity adversely affects the electrical circuitry of the mechanism. Furthermore, the inevitable dust accumulation on the phototube impairs its proper functioning. The microswitch as used in the conventional counting mechanism has ordinarily been positioned midway along the path of travel of the successive sheets from the sheet stand to the recovery mechanism, so as to respond to the thickness of each sheet traveling therepast. The microswitch thus arranged is required to be highly sensitive and tends to operate erroneously in the event the sheets are supplied irregularly from the sheet stand.

A further difficulty accompanying the piror art apparatus makes its appearance when the same is employed for counting bills of various denominations, which ordinarily differ in size. The various parts of the prior art apparatus have mostly been designed to accommodate sheets of predetermined dimensions only. For counting bills or other sheets of various sizes by a single apparatus, therefore, several interchangeable sheet stands, sheet recovery receptacles and the like have had to be prepared for the respective sizes of sheets.

SUMMARY OF THE INVENTION

In view of the listed difficulties encountered in the prior art, it is an object of this invention to provide improved sheet counting apparatus with a friction-type infeed mechanism, wherein the various constituent mechanisms of the apparatus are so arranged as to minimize the bulk of the apparatus.

Another object of the invention is to provide, in the sheet counting apparatus of the type described, a counting mechanism which is simple and inexpensive in construction and reliable in operation, and which is arranged sufficiently close to the sheet stand of the apparatus so that no special space is required within the apparatus for accommodating the counting mechanism.

Still another object of the invention is to provide, in the sheet counting apparatus of the type described, an adjusting mechanism whereby the position of the sheets in the sheet stand and in a sheet recovery mechanism is easily adjustable, as by the manual turn of a knob, in accordance with their size so that the apparatus is made capable of handling bills or like sheets of various known sizes with equal efficiency.

A further object of the invention is to provide, in the sheet counting apparatus of the type described, a friction-type infeed mechanism whereby the sheets in the sheet stand can be unfailingly supplied only one by one into the apparatus, so that the reliability of the apparatus with the friction-type infeed mechanism is materially enhanced.

A still further object of the invention is to provide, in the sheet counting apparatus of the type described, a sheet recovery mechanism which permits the counted sheets to be withdrawn from the apparatus in the form of a neat stack regardless of their size.

Briefly summarized, this invention contemplates the provision of sheet counting apparatus including a sheet stand in which a batch of sheets to be counted is placed in a neat arrangement on one of their edges. An infeed mechanism arranged forwardly of the sheet stand comprises first and second infeed rolls disposed in parallel, spaced relationship to each other for frictionally feeding the successive foremost ones of the sheets away from the sheet stand. Counting means positioned close to the sheet stand includes at least one sensing roll displaceably mounted under the second infeed roll so as to be displaced a predetermined distance by each sheet traveling thereover, and a counter switch operatively connected to the sensing roll is actuated each time the latter is thus displaced. A conveyor mechanism typically comprising a plurality of parallel, spaced endless belts receives at one extremity thereof the successive counted sheets from between the second infeed roll and the sensing roll and transports the sheets to the other extremity, where the counted sheets are successively stacked up by a recovery mechanism for easy withdrawal from within the apparatus.

The features which are believed to be novel and characteristic of this invention are set forth with particularity in the appended claims. The invention itself, however, both as to its organization and manner of operation, together with the further objects and advantages thereof, will be best understood from the following description when taken in conjunction with the accompanying drawings wherein like reference characters denote like parts throughout the several views.

DETAILED DESCRIPTION

Figure 1:
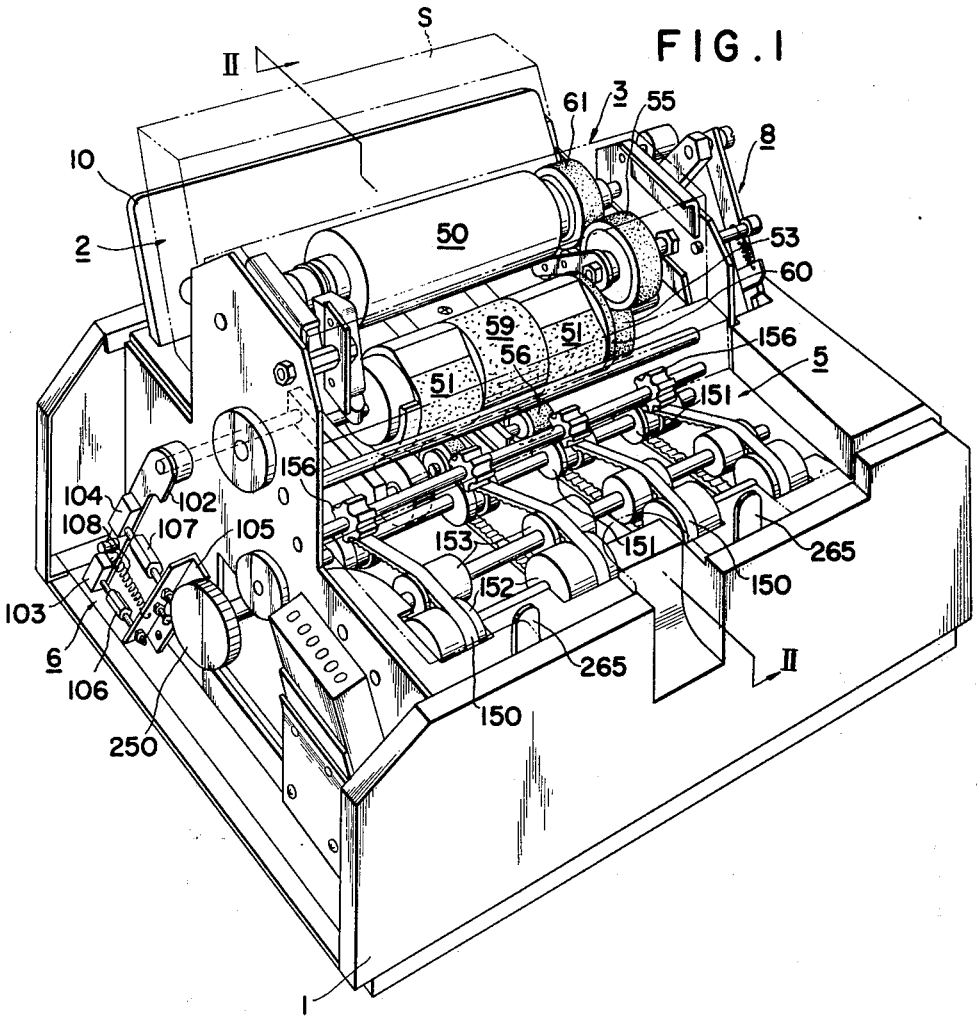
FIG. 1 is a perspective view of the sheet counting apparatus constructed in accordance with the concepts of this invention, in which the casing and the sheet recovery mechanism are shown partly broken away to illustrate the inner details of the apparatus.
Figure 2:
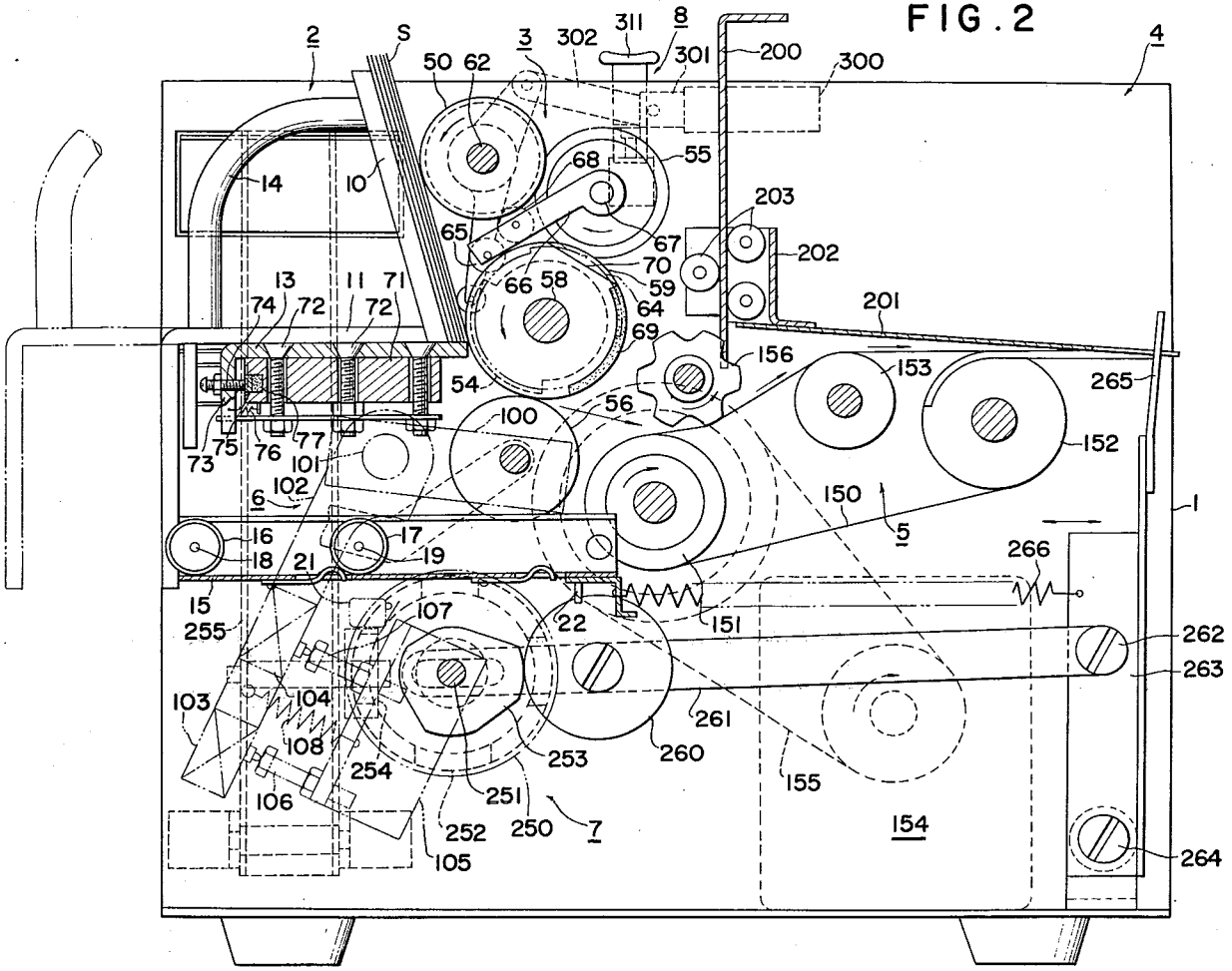
FIG. 2 is a vertical sectional view taken substantially along the plane of line II—II in FIG. 1.
Figure 3:
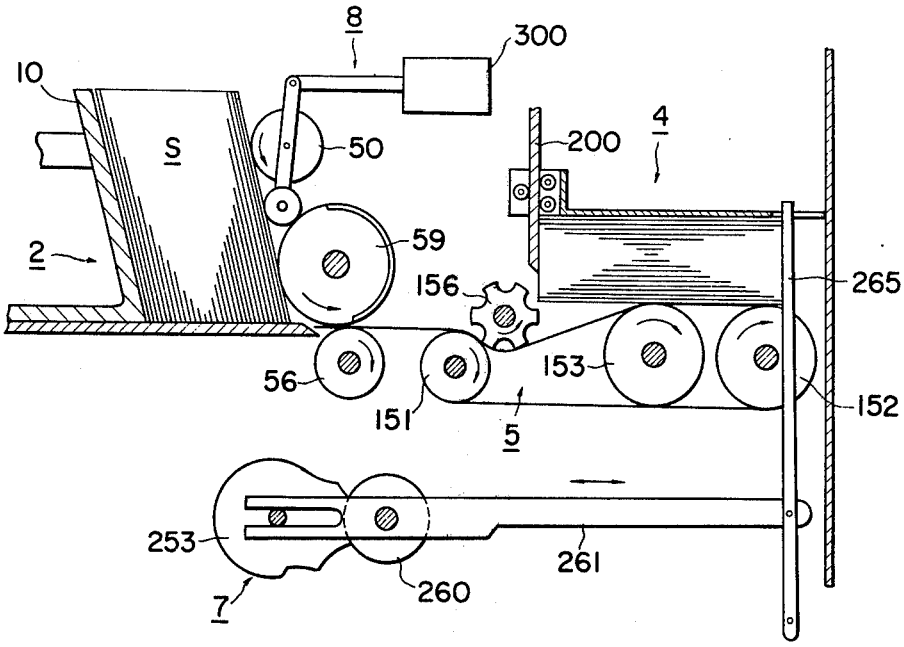
FIG. 3 is a diagrammatic view similar to FIG. 2 and explanatory of the operating condition of the sheet counting apparatus.

As will be seen from FIGS. 1, 2, and 3, the sheet counting apparatus illustrated therein by way of a preferred embodiment of this invention includes a substantially box-like casing of framework 1 having a sheet stand 2 formed on its top adjacent the rear end of the apparatus, seen to the left in FIGS. 2 and 3. A neat pack of rectangular sheets S to be counted is to be manually placed in this sheet stand 2 so as to stand on one of their longitudinal edges, as will be later described. An infeed mechanism 3 is provided on the forward side of the sheet stand 2 for feeding the sheets S into the apparatus one by one.

A sheet recovery mechanism 4 is also arranged on the top of the framework 1 adjacent the front end thereof for recovery of the successive sheets which have been counted within the apparatus. A conveyor mechanism 5 extends from under the infeed mechanism 3 to the recovery mechanism 4 for the transport to the latter of the successive sheets fed into the apparatus by the infeed mechanism. A counting mechanism 6 (not shown in FIG. 3) arranged under the sheet stand 2 coacts with the infeed mechanism 3 for counting the successive sheets as they are fed into the apparatus.

Arranged under the infeed mechanism 3 and the conveyor mechanism 5 is an adjusting mechanism 7 adapted for the manual adjustment of the position of the sheets S in the sheet stand 2 and in the recovery mechanism 4 in accordance with their size. A stop motion mechanism 8 on the forward side of the sheet stand 2 includes means for pushing back the pack of sheets S in the sheet stand during operation of the apparatus, in order to instantly suspend or nullify the infeeding motion of the infeed mechanism 3.

The various mechanisms listed in the foregoing constitute the principal, but not necessary essential, components of the sheet counting apparatus according to the invention, and these mechanisms are hereinafter described in more specific aspects thereof under respective headings.

SHEET STAND

Figure 4:
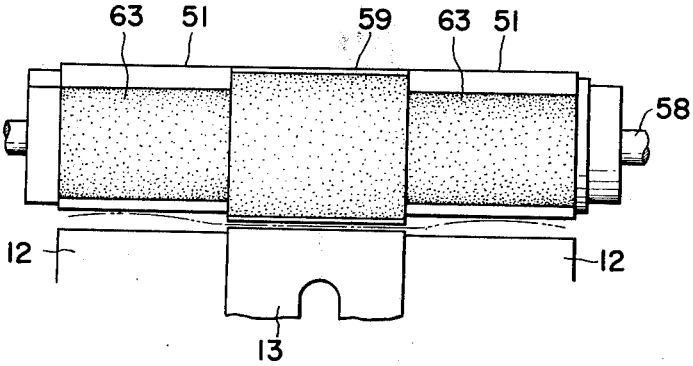
FIG. 4 is a fragmentary top plan view explanatory of the gate mechanism of the apparatus shown in FIGS. 1 and 2.

As best seen in FIGS. 2 and 4, the sheet stand 2 includes a rearwardly inclined back plate 10 rigidly coupled at its lower end to an L-shaped handle 11 so as to be slidable back and forth over the bottom of the sheet stand consisting of a pair of spaced apart stationary plates 12 and a movable plate 13 sandwiched therebetween in coplanar relationship. The structural and functional details of the movable bottom plate 13 of the sheet stand 2 will be later described in connection with the infeed mechanism 3. The back plate 10 and the handle 11 are further interconnected by a bracket 14 so as to be solidly retained in their desired relative positions as shown in FIG. 2.

The aforesaid L-shaped handle 11 is rigidly coupled to a guide 15 of U-shaped cross section riding over rolls 16 and 17 rotatably mounted on their respective shafts 18 and 19. The guide 15 is biased forwardly by a tension spring 20, so that the sheets S in the sheet stand 2 are urged toward the infeed mechanism 3 by the back plate 10. A microswitch 21 is adapted to be actuated by a pin 22 projecting downwardly from the guide 15 when the handle 11 is manually pulled backward against the bias of the tension spring 20 to load the sheets S in the sheet stand 2. This microswitch may be utilized, for example, for resetting a sheet counter, not shown, of the counting mechanism 6.

INFEED MECHANISM

Figure 5A:
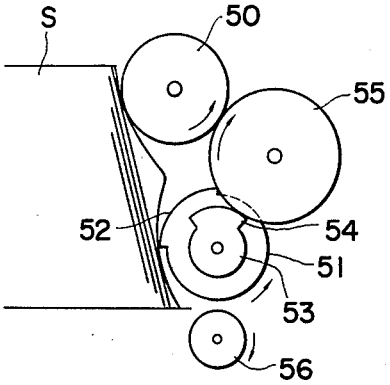
FIGS. 5(*a*), 5(*b*), and 5(*c*) are schematic side elevational views explanatory of the operating principles of the infeed mechanism of the apparatus shown in FIGS. 1 and 2.
Figure 5B:
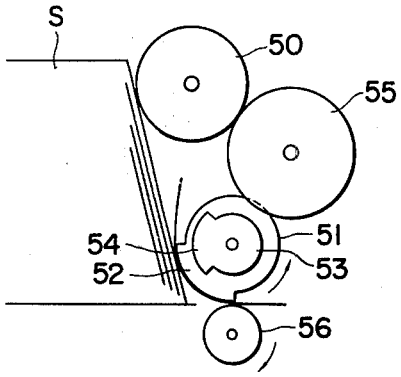
Figure 5C:
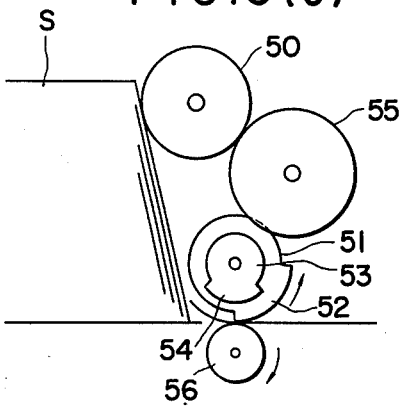
Figure 6A:
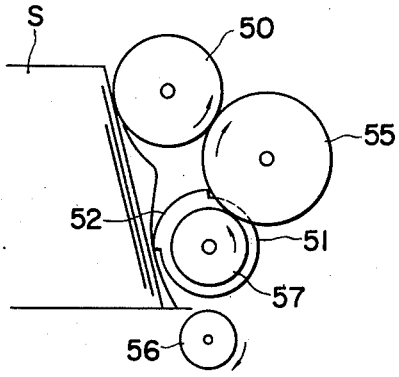
FIGS. 6(*a*) and 6(*b*) are also schematic side elevational views showing a modification of the configuration shown in FIGS. 5(*a*), 5(*b*) and 5(*c*)
Figure 6B:
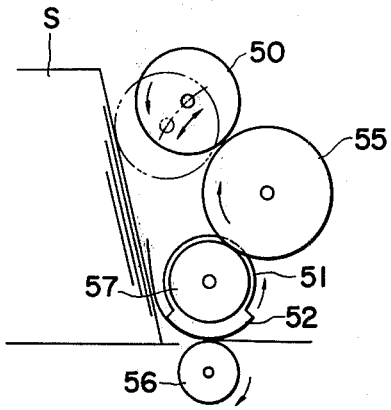

The principles underlying the operation of the infeed mechanism 3 will be understood from the following description of the diagrammatic views of FIGS. 5 and 6. Referring first to FIGS. 5(*a*), 5(*b*), and 5(*c*), first and second infeed rolls 50 and 51 are rotatably mounted in parallel, spaced relationship to each other adjacent both longitudinal edges, respectively, of the pack of sheets S in the sheet stand 2. The first infeed roll 50 is of exactly cylindrical shape, and its entire circumference is capable of frictional contact with the foremost one of the sheets S in the sheet stand 2. The second infeed roll 51 is also of substantially cylindrical shape except for a circumferential portion 52 of greater radius provided longitudinally thereon, and this circumferential portion only of the second infeed roll is capable of frictional contact with the foremost sheet.

A cam roll 53 is mounted coaxially with the second infeed roll 51 for joint rotation therewith. This cam roll 53 has a circumferential portion 54 of greater radius which is a predetermined angle out of phase with the greater radius portion 52 on the second infeed roll 51. The second infeed roll and the cam roll are held in constant rotation during operation of the apparatus. An intermediate roll 55 is rotatably mounted between the first infeed roll 50 and the cam roll 53 for frictional contact with the entire circumference of the former and with the greater radius portion 54 of the latter. The reference numeral 56 denotes a sensing roll of the counting mechanism 6 which is rotatably and displaceably mounted under the second infeed roll 51 and which is spring-actuated into circumferential contact with the greater radius portion 52 of the second infeed roll.

In the operation of the configuration schematically represented in FIG. 5, the rotation of the first infeed roll 50 is initiated via the intermediate roll 55 when the greater radius portion 54 on the constantly rotating cam roll 53 moves into frictional contact with the latter, as will be seen from FIG. 5(*a*). The thus initiated rotation of the first infeed roll 50 continues as long as the intermediate roll 55 remains in frictional contact with the greater radius portion 54 on the cam roll 53. In the meantime the foremost one of the sheets S in the sheet stand 2 becomes partly folded about its approximately central longitudinal axis as its upper edge slides downwardly relative to the next sheet by friction exerted by the first infeed roll 50.

Succeedingly, the greater radius portion 52 on the second infeed roll 51 in constant rotation moves into frictional contact with the foremost sheet which has been partly separated from the rest of the sheets by the first infeed roll 50, thereby feeding the foremost sheet further downwardly toward the sensing roll 56. The greater radius portion 52 on the second infeed roll 51 and the sensing roll 56 thereafter cooperate to carry the foremost sheet away from the rest of the sheets, as illustrated in FIGS. 5(*b*) and 5(*c*).

The above procedure is repeated as the greater radius portion 54 on the cam roll 53 revolves again into frictional contact with the intermediate roll 55 to resume the rotation of the first infeed roll 50. Each foremost sheet in the sheet stand 2 is thus successively carried away from the rest of the sheets S. It will be apparent that the first infeed roll 50 and the intermediate roll 55 are both held out of rotation while each foremost sheet is being transported away from the sheet stand 2 by the second infeed roll 51 and the sensing roll 56, and that the first infeed roll is set in rotation via the intermediate roll to partly separate the next foremost sheet from the rest of the sheets S when the preceding sheet has completely been carried away from the sheet stand. Such intermittent rotation of the first infeed roll 50 is effected by the cam roll 53 in cooperation with the intermediate roll 55, in such a way that the sheets S in the sheet stand 2 can unfailingly be fed one by one into the next stage in the sheet counting apparatus.

Although not directly associated with the sheet counting apparatus shown in FIGS. 1 and 2, the configuration schematically illustrated in FIG. 6 is also effective to feed the successive sheets S into the apparatus through a similar procedure. The cam roll 53 of the FIG. 5 configuration is here replaced by a drive roll 57 of the usual cylindrical shape. The drive roll 57 is mounted coaxially with the second infeed roll 51 for joint rotation therewith and is adapted for continuous driving relationship with the first infeed roll 50 via the intermediate roll 55. The first infeed roll 50 thus held in constant rotation, however, is not held in constant contact with each foremost one of the sheets S in the sheet stand 2 as in the FIG. 5 configuration. Instead, the first infeed roll is pivotable about the axis of the intermediate roll 55 and is retained in its retracted position away from the sheets S while each foremost sheet is being carried away from the sheet stand 2 by the second infeed roll 51 in cooperation with the sensing roll 56.

The pivoting motion of the first infeed roll 50 about the axis of the intermediate roll 55 is timed with the angular position of the greater radius portion 52 on the second infeed roll 51 in such a way that the first infeed roll retracts from the sheets S when the greater radius portion on the second infeed roll turns into abutting contact with each foremost sheet which has been partly separated from the rest of the sheets by the first infeed roll, as shown in FIG. 6(*a*). When the foremost sheet is completely carried away from the sheet stand 2 by the second infeed roll 51 and the sensing roll 56, the first infeed roll 50 moves back into frictional contact with the next foremost sheet in the sheet stand, as will be seen from FIG. 6(*b*). Such reciprocal pivoting motion of the first infeed roll 50 may be effected by means such as a crank mechanism, not shown, operating in relation to the rotation of the second infeed roll 51 and the drive roll 57.

Referring back to FIGS. 1 and 2 in particular, the infeed mechanism 3 of the sheet counting apparatus illustrated therein includes a pair of longitudinally spaced second infeed rolls 51 fixedly mounted on a drive shaft 58. A gate roll 59 is also fixedly mounted on the drive shaft 58 between the pair of second infeed rolls 51, the gate roll being of substantially the same diameter as the second infeed rolls. Further fixedly mounted on the drive shaft 58 adjacent one end thereof are a driving cam roll 53 and a braking cam roll 60. The driving cam roll 53 has the greater radius portion 54 on its circumference, indicated by the dashed line in FIG. 2, which is adapted for frictional contact with the circumference of the intermediate roll 55 which in turn is held in constant frictional circumferential contact with a driven roll 61 mounted on the same rotatable shaft 62 as the first infeed roll 50 for joint rotation therewith. The counterclockwise rotation, as viewed in FIG. 2, of the drive shaft 58 is thus conveyed intermittently to the first infeed roll 50 to cause the same also to rotate in the counterclockwise direction.

Instead of the greater radius portion 52 set forth in connection with FIGS. 5 and 6, each of the second infeed rolls 51 has what may be termed a frictional contact portion 63, FIG. 4, on its circumference the circumferential length of which may be slightly less than the width of each sheet to be fed into the apparatus. Typically, the frictional contact portion 63 may take the form of a sheet of rubber or like material capable of frictional contact with the surface of each sheet to be fed into the apparatus, such sheet of rubber or the like being cemented onto the desired part of the circumference of each second infeed roll 51.

The infeed mechanism 3 includes a brake mechanism adapted to restrain the first infeed roll 50 from any inertial rotation at the conclusion of each intermittent rotation. The brake mechanism includes the braking cam roll 60 having a greater radius portion 64 on its circumference, indicated by the dot-and-dash line in FIG. 2, which is completely reversed in phase relationship with respect to the greater radius portion 54 on the driving cam roll 53. A cam follower roll 65 to be actuated by this braking cam roll 60 is rotatably supported on one end of an arm 66 which is pivoted at the other end thereof on the shaft 67 rotatably supporting the intermediate roll 55. A brake element 68 of cylindrical shape is mounted intermediate both ends of the arm 66 for abutting contact with the circumference of the driven roll 61. Thus, each time the greater radius portion 64 on the braking cam roll 60 revolves into sliding contact with the cam follower roll 65, the arm 66 swings clockwise, as viewed in FIG. 2, on the shaft 67 thereby urging the brake element 68 into abutting contact with the driven roll 61 and hence restraining the first infeed roll 50 from inertial rotation.

Since the rotation of the first infeed roll 50 is thus forcibly arrested at the instant each foremost sheet is released therefrom by shifting down toward the second infeed rolls 51, the first infeed roll is effective to frictionally retain the next sheet in position on the sheet stand 2 during the succeeding infeeding motion of the foremost sheet by the second infeed rolls. It is possible in this manner to substantially preclude the possibility of two sheets being fed simultaneously into the apparatus.

The infeed mechanism 3 further includes a gate mechanism adapted to make doubly sure that the sheets S will be fed into the apparatus only one by one. The gate mechanism includes the aforesaid gate roll 59 which is fixedly mounted on the drive shaft 58 for joint rotation with the second infeed rolls 51 and which is adapted to define a gate spacing between its circumference and the opposed edge of the movable bottom plate 13 of the sheet stand 2, as will be best understood from FIG. 4. The gate spacing is adjustable by means later described so that only one sheet will be permitted to pass therethrough at one time.

Desirably, a sheet of rubber or like material capable of frictional contact with each sheet to be fed into the apparatus is also cemented onto part of the circumference of the gate roll 59 in the same phase relationship to the frictional contact portions 63 of the second infeed rolls 51, as indicated at 69 in FIG. 2, so that gate roll will coact with the second infeed rolls to frictionally carry each foremost one of the sheets S away from the sheet stand 2. It should be noted that the frictional contact portions 63 of the second infeed rolls 51 and the frictional contact portion 69 of the gate roll 59 are both made substantially equal in radius to the other circumferential portions of the second infeed rolls and the gate roll in the FIGS. 1 and 2 embodiment. However, as indicated at 70 in FIG. 2, each of the second infeed rolls only has an indentation formed on its circumference forwardly of the frictional contact portion 63 with respect to its direction of rotation. By the provision of these indentations 70, the aforesaid gate spacing can be defined only by the circumference of the gate roll 59 and the opposed edge of the movable bottom plate 13 of the sheet stand 2.

In order to adjust the gate spacing to the thickness of each sheet to be fed into the apparatus, the movable bottom plate 13 of the sheet stand 2 is slidably mounted on a stationary support 71. An array of bolts 72 extending through the movable bottom plate 13 are slidably received in respective slots formed through the stationary 71, so that the movable bottom plate is constrained in front-and-rear sliding motion relative to the stationary support. The movable bottom plate 13 terminates at its rear end in a down turned flange 73, and an adjusting bolt 74 extends through this flange to be somewhat loosely received in a bore 75 formed in the stationary support 71. The movable bottom plate 13 is biased forwardly by a tension spring 76. Thus, by manually rotating the nut on the adjusting bolt 74, the position of the movable bottom plate on the stationary support 71 is varied to adjust the gate spacing to the thickness of each sheet to be counted.

When the sheet counting apparatus is operated for any extended length of time, however, the frictional contact portion 69 of the gate roll 59 may expand in bulk due to the heat generated by its repeated frictional contact with each sheet fed into the apparatus, thereby significantly narrowing the preset gate spacing. In order to prevent this, a mass 77 of material having the same or similar coefficient of thermal expansion as that of the frictional contact portion 69 is packed in the bore 75. The horizontal dimension of this mass 77 of thermally expansible material should be suitably determined in relation to the thickness of the frictional contact portion 69 on the circumference of the gate 59 and also with the material in use. The material mass 77 is subject to thermal expansion due to some vibratory motion produced by the infeed mechanism 3 with a resultant rearward displacement of the movable bottom plate 13 via the adjusting bolt 74, whereby the gate spacing can be held constant throughout the prolonged use of the apparatus.

COUNTING MECHANISM

As seen in FIGS. 1 and 2, the counting mechanism 6 includes one or more (two in this embodiment) sensing rolls 56 each rotatably supported on one end of a bracket 100 under the second infeed rolls 51 with a slight spacing therebetween. The bracket 100 at the other end is fixedly mounted on rotatable shaft 101 so as to be pivotable about its axis, and an arm 102 is also fixedly mounted on this rotatable shaft 101 at one end thereof for swinging movement in step with the bracket 100. The arm 102 carries two switches 103 and 104 in longitudinally spaced positions adjacent the other end thereof. The switch 103 may be called the counter switch, and the switch 104 the fault detector switch. A bracket 105 is affixed to the framework 1 for supporting switch actuators 106 and 107 associated with respective switches. The arm 102 is biased toward the bracket 105 by a tension spring 108.

Although the electrical details are not specifically illustrated because of their common and well known nature, it is assumed that the counter switch 103 is connected to a counter of known construction which counts the pulses delivered therefrom, and the fault detector switch 104 is connected to the stop motion mechanism 8 to be later described. The counter switch 103 produces a pulse signal when actuated as a result of a clockwise swing, as viewed in FIG. 2, of the arm 102 by the passage of each sheet between the second infeed rolls 51 and the sensing rolls 56. The fault detector switch 104 produces a pulse signal only upon simultaneous passage of two or more sheets between the second infeed rolls and the sensing rolls, because then the angle of swing of the arm 102 is greater than that caused upon passage of one sheet therebetween. The signal thus produced by the fault detector switch 104 may be utilized to actuate not only the stop motion mechanism 8 but suitable means, not shown, for automatic removal of the two or more superimposed sheets from within the apparatus. The positions of the switch actuators 106 and 107 relative to the respective switches 103 and 104 are easily adjustable as by use of adjusting bolts or the like as the switch actuators.

It is noteworthy that the switches 103 and 104 need not be so-called microswitches or of any special type or class. Ordinary switches are employable if their positions on the arm 102 are appropriately varied in accordance with the distances their movable contacts are required to travel for proper actuation. This leads to substantial economy in manufacturing costs. It will be apparent that, contrary to the arrangement in the FIGS. 1 and 2 embodiment, the switches 103 and 104 can be mounted on the bracket 105, and the switch actuators 106 and 107 on the arm 102. This alternative arrangement is advantageous in that less load is imposed upon the arm 102.

CONVEYOR MECHANISM

Also as best illustrated in FIGS. 1 and 2, the conveyor mechanism 5 extending from the infeed mechanism 3 to the recovery mechanism 4 includes a plurality of parallel, spaced endless conveyor belts 150 extending in substantially coplanar relationship around terminal pulleys 151 and 152 and intermediate pulleys 153. These pulleys 151, 152 and 153 are rotatably supported by their respective shafts arranged transversely of the sheet counting apparatus. The pulleys 151 are drive pulleys coupled to a drive motor 154 via a belt drive 155. A plurality of star wheels 156 are rotatably mounted adjacent the rear or receiving end of the conveyor mechanism 5 so as to be in peripheral contact with the upper spans of the respective endless conveyor belts 150. The functioning of these star wheels will be later made apparent in connection with the sheet recovery mechanism 4.

RECOVERY MECHANISM

With particular reference to FIG. 2, the sheet recovery mechanism 4 includes a vertical guide plate 200 secured to the framework 1 of the sheet counting apparatus. A substantially horizontal sheet holder plate 201 is secured at its rear end to a member 202 which rotatably supports a plurality of rollers 203 arranged so as to embrace the guide plate 200. Thus, as the sheets which have been sucessively fed into the apparatus by the infeed mechanism 3 and counted by the counting mechanism 6 are gradually stacked on or adjacent the front end of the conveyor mechanism 5, the shaft holder plate 201 is raised by degrees along the guide plate 200 via the rollers 203, as will be understood from FIG. 3. The sheet holder plate 201 thus functions to hold the gradually increasing stack of sheets in position on the conveyor mechanism 5.

It should be noted that, as will be seen from a consideration of FIG. 3, the aforesaid star wheels 156 are so positioned on the respective conveyor belts 150 that their teeth will engage the trailing edge of each sheet which has been transported to its proper recovery position under the sheet holder plate 201. Since the trailing edges of the sheets stacked under the sheet holder plate 201 are thus raised off the surfaces of the conveyor belts 150, each successive sheet can be fed properly under the stack of preceding sheets.

ADJUSTING MECHANISM

Figure 7:
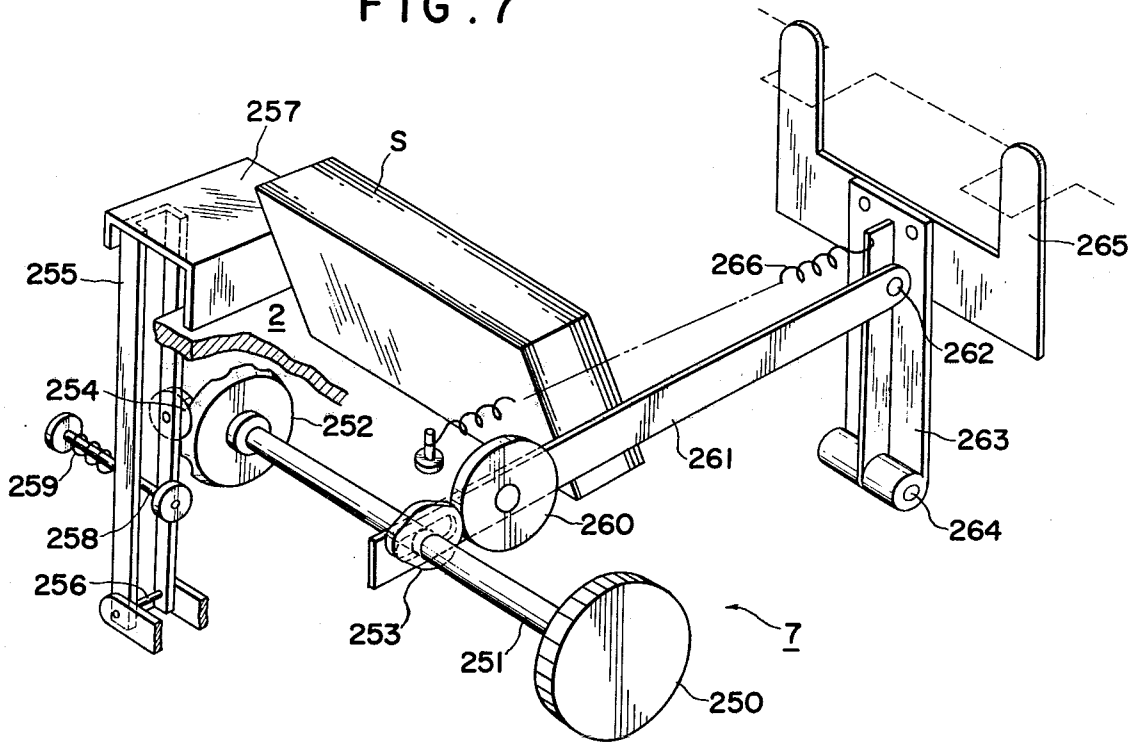
FIG. 7 is an enlarged perspective view of the adjusting mechanism of the sheet counting apparatus.

As best illustrated in FIG. 7, the adjusting mechanism 7 includes a knob 250 located in an easily accessible position on the outside of the apparatus and fixedly mounted on one end of a rotatable shaft 251 arranged under the sheet stand 2. Two cams 252 and 253 are also fixedly mounted on the rotatable shaft 251. The cam 252 is adapted to operatively engage a cam follower roll 254 mounted intermediate the two ends of a vertical arm 255. The arm 255 is pivotally supported at its bottom end means such as a pin 256 and terminates at its top end in a guide 257 extending over the bottom of the sheet stand 2 adjacent one lateral end thereof. The arm 255 is constrained in swinging motion on the pin 256 in the transverse direction of the apparatus by a guide rod 258 loosely extending therethrough. The cam follower roll 254 is urged into abutment on the cam 252 by a helical compression spring 259 wound around the guide rod 258.

Abutting on the other cam 253 is a cam follower roll 260 rotatably mounted adjacent one end of a link 261 which at the other end is pinned at 262 to a vertical arm 263. This arm 263 is pivoted by a pin 264 at its bottom end and is secured at its top end to an abutment 265 including a pair of fingers extending upwardly at the front end of the sheet recovery mechanism 4 to serve as adjustable stops for the sheets successively transported by the conveyor mechanism 5. The roll 260 is urged against the cam 253 by a spring 266.

As previously set forth in connection with the counting mechanism 6, the fault detector switch 104 carried by the arm 102 is actuated when two or more sheets travel in superposition between the second infeed rolls 51 and the sensing rolls 56, thereby detecting the faulty operation of the infeed mechanism 3. However, the fault detector switch may be similarly actuated even when the sheets are being properly fed one by one, if folds or creases of the sheets, or adhesive tapes of cellophane or the like used to mend cuts in the sheets, happen to pass over the sensing rolls 56. In the case of bills, which are often folded twice into four parts, such folds, creases or cuts are most likely to exist along the transverse lines dividing them into four equal parts. The sensing rolls 56 must therefore be so located relative to the sheet stand 2 as to avoid these transverse lines of the bills. Since the size of the bills usually differ from one denomination to another, their position on the sheet stand 2 must be shifted transversely in accordance with their denomination.

To this end, the knob 250 may be manually rotated to a specific angular position in accordance with the denomination or size of the sheets to be counted. The cam 252 is then turned to a corresponding angular position via the shaft 251. In accordance with the position in which the cam follower roll 254 is engaged by the cam 252, the arm 255 swings on the pin 256 to shift the guide 257 to such a position on the bottom of the sheet stand 2 that the aforesaid transverse lines of the sheets S will be held out of alignment the sensing rolls 56.

Upon manual turning of the knob 250, the other cam 253 also operates to cause the arm 263 to swing on the pin 264 via the cam follower roll 260 and the link 261. The abutment 265 is thus simultaneously shifted either back or forth, to a position determined in accordance with the width of the sheets to be counted, so that the sheets which have been successively transported by the conveyor mechanism 5 can be properly stacked under the sheet holder plate 201.

It will be understood that the adjustable guide 257 is also employable, by suitably modifying the contour of the cam 252, for holding the sheets S in an exactly central position on the sheet stand S regardless of their length or horizontal dimension, in order that the sheets may be stacked centrally under the sheet holder plate 201.

STOP MOTION MECHANISM

Figure 8:
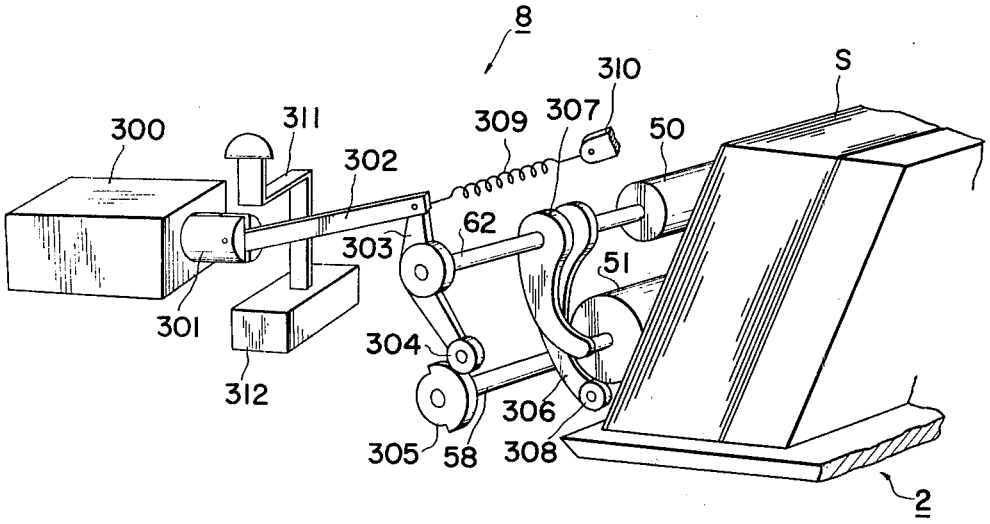
FIG. 8 is a perspective view of the stop motion mechanism of the apparatus.

The details of the stop motion mechanism 8 are illustrated in FIG. 8. A solenoid 300 suitably supported by the framework 1 of the apparatus has its plunger 301 pivotally connected to a link 302 at one end thereof. The other end of the link 302 is also pivotally connected to one end of a lever 303 fixedly mounted at its mid-point on the shaft 62 rotatably supporting the first infeed roll 50 of the infeed mechanism 3. The lever 303 carries a cam follower roll 304 on the other end thereof which roll abuts on the stepped circumference of a cam 305 fixedly mounted on the drive shaft 58 of the infeed mechanism 3. During operation of the apparatus, therefore, the cam 305 imparts oscillatory motion to the lever 303 via the cam follower roll 304.

Also fixedly mounted on the shaft 62 are arms 306 and 307. The arm 306 terminates in a roll 308 abutting on the sheets S in the sheet stand 2 at a point adjacent the lower edge thereof. Since the lever 303 is oscillated as aforesaid by the cam 305, the roll 308 is effective to impart vibratory motion to each foremost one of the sheets S in the sheet stand 2, thereby aiding in the infeeding operation of the mechanism 3. The tip of the other arm 307 is held a predetermined distance away from the foremost one of the sheets S.

Figure 9:
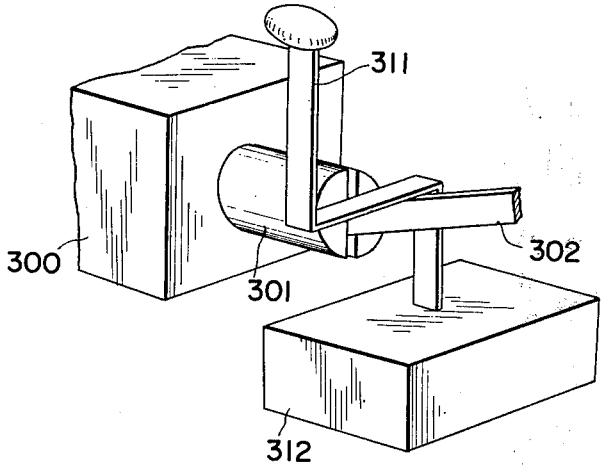
FIG. 9 is an enlarged, fragmentary perspective view explanatory of the operation of the stop motion mechanism shown in FIG. 8.

A restoring spring 309 extends between the link 302 and a stationary part 310 to return the plunger 301 to its advanced position upon deenergization of the solenoid 300. Mounted adjacent the solenoid 300 is a manually actuable locking lever 311 which, when depressed while the solenoid is being energized, engages and locks the plunger 301 in its retracted position as illustrated in FIG. 9. Upon manual depression of the locking lever 311, a switch 312 is simultaneously actuated to terminate the operation of the drive motor 154 which drives the conveyor mechanism 5 and, via means not shown in the drawings, the infeed mechanism 3.

During normal operation of the apparatus, the solenoid 300 is held unenergized, so that its plunger 301 is held in its advanced position to retain the tip of the arm 307 in its inoperative position away from the sheets S in the sheet stand 2. By rotation imparted to the drive shaft 58 from the motor 154, the infeed mechanism 3 operates in the above described manner to feed each foremost one of the sheets S into the apparatus, aided by the oscillating roll 308 at the tip of the arm 306.

However, when a desired number of sheets has been counted, or when the fault detector switch 104 is actuated, the solenoid 300 becomes energized via means well known to those skilled in the art, thereby causing the plunger 301 to move to its retracted position against the bias of the tension spring 309. Since the lever 303 is thereupon turned counterclockwise, as viewed in FIG. 8, with the shaft 62 via the link 302, the arms 306 and 307 simultaneously swing toward the sheets S to push the same rearwardly against the back plate 10 best illustrated in FIG. 2. With the sheets S thus moved out of contact with the infeed rolls 50 and 51, no more sheets can be fed into the apparatus in spite of the continued operation of the infeed mechanism 3.

After the infeeding operation by the mechanism 3 has been terminated in the above described manner, the locking lever 311 may be manually depressed to lock the plunger 301 in its retracted position as illustrated in FIG. 9. The switch 312 is simultaneously actuated to cut off the electric power supply of the apparatus, whereby the drive motor 154 is stopped while the solenoid 300 becomes deenergized. It will be apparent that the plunger 301 is retained in its retracted position in spite of this solenoid deenergization, so that there is practically no possibility of additional sheets being fed accidentally into the apparatus. The operation of the apparatus can be resumed by pulling the locking lever 311 up to the FIG. 8 position out of engagement with the plunger 301 of the solenoid 300.

GENERAL OPERATION

As will be seen from FIG. 2, the neat pack of sheets S to be counted is first placed in the sheet stand 2 by manually pulling the L-shaped handle 11 rearward against the force of the tension spring 20. Upon release of the handle 11, the spring 20 imposes a suitable forward force on the sheets S via the back plate 10. As the drive motor 154 is succeedingly set in operation, its rotation is imparted simultaneously to the second infeed rolls 51 and gate roll 59 of the infeed mechanism 3 and to the drive pulleys 151 of the conveyor mechanism 5 thereby initiating the operations of these mechanisms 3 and 5. The infeed mechanism 3 operates in the fashion described to feed each foremost one of the sheets S into the apparatus.

As each sheet from the sheet stand 2 travels over the sensing rolls 56 of the counting mechanism 6, the sensing rolls are displaced downward a distance corresponding to the thickness of the sheet thereby causing the arm 102 to swing clockwise through a corresponding angle. The counter switch 103 is thus actuated, and the counter (not shown) counts the pulses delivered from this counter switch 103 each time the same is actuated. The fault detector switch 104 also mounted on the arm 102 is actuated only when two or more sheets pass in superposition over the sensing rolls 56 because, then, the arm will be caused to swing through a greater angle. The solenoid 300 of the stop motion mechanism 8 becomes energized upon actuation of the fault detector switch 103, so that the infeeding operation of the sheets S is suspended immediately through the procedure set forth in connection with the mechanism 8.

Each sheet that has been properly fed into the apparatus by the infeed mechanism 3 and counted by the counting mechanism 6 is then loaded on the endless conveyor belts 150 of the conveyor mechanism 5 at its rear or receiving end and is transported forward until the leading edge of the sheet comes into contact with the abutment 265 whose position is adjustable by the adjusting mechanism 7 in accordance with the width of the sheet. The successive sheets can thus be stacked up under the upwardly movable sheet holder plate 201 of the recovery mechanism 4. It will be recalled that the trailing edges of the stack of sheets under the sheet holder plate 201 are raised off the surfaces of the endless conveyor belts 150 by the star wheels 156 rotating counterclockwise, as viewed in FIG. 2, in frictional contact therewith, so that each successive sheet can be fed properly under the stack of preceding sheets.

When a desired number of the sheets S are thus counted and recovered under the sheet holder plate 201, the solenoid 300 of the stop motion mechanism 8 becomes energized to cause the arms 306 and 307 to push the remaining sheets S in the sheet stand 2 back against the back plate 10, so that no more sheets can be fed into the apparatus in spite of the continued operation of the infeed mechanism 3. The rotation of the drive motor 154 can be terminated by manual depression of the locking lever 311. Other details of operation are as previously set forth in conjunction with the respective constituent mechanisms 2 through 8 of the apparatus.

It will be understood that the infeed mechanism 3, recovery mechanism 4, conveyor mechanism 5, stop motion mechanism 8 and so forth of the sheet counting apparatus disclosed herein are employable not only for counting but for other sheet processing purposes, by replacing the counting mechanism 6 with some other pertinent mechanism.

Having thus described the several useful and novel features of the sheet counting apparatus according to the invention in connection with the accompanying drawings, it will be seen that the various objects of the invention, either explicitly stated or otherwise set forth, have been fully achieved. However, various modifications of the apparatus as disclosed herein may well occur to those skilled in the art, without departing from the true spirit and scope of the invention.

What is claimed is:

1. In a sheet counting apparatus, the combination comprising:

a. a casing in which a stack of sheets to be counted is placed on one of their edges;

b. a sheet stand on the top of said casing, said sheet stand including means for exerting a forward pressure on the sheet-stack;

c. infeed means arranged forwardly of said sheet stand, said infeed means including at least one infeed roll which is rotatably mounted adjacent to one edge of the sheets in said sheet stand for frictionally and successively feeding out the foremost one of the sheets of a stack away from said sheet stand;

d. counting means arranged adjacent to said sheet stand for counting number of sheets successively fed from said sheet stand by said infeed means, said counting means including 1. at least one sensing roll rotatably mounted under said infeed roll so as to be displaceable away from said infeed roll in response to travelling of each sheet between said infeed roll and said sensing roll, 2. an arm on which said sensing roll is mounted, said arm being pivotally supported at one end thereof so as to be swingable through an angle corresponding to the degree of displacement of said sensing roll, and 3. a counter switch mounted on the other end of said arm, said counter switch being adapted to be actuated each time when a single sheet travels over the sensing roll;

e. conveyor means having a rear end disposed adjacent to said infeed means and a front end being remote from said infeed means, whereby the successively counted sheets loaded on said conveyor means at said rear end are transported to said front end thereof;

f. recovery means for recovering the counted and transported sheets from said conveyor means in the form of a substantially neat stack, said recovery means including

1. an abutment arranged forwardly of said front end of said conveyor means for stopping the successively counted sheets transported thereby, said abutment being effective to form a stack of the sheets on said front end of said conveyor means, and

2. a sheet holder plate arranged horizontally over said front end of said conveyor means for holding the stack of sheets in position thereon, said sheet holder plate being displaceable upwardly in step with the increase in the height of the stack of sheets; and g. drive means for driving said infeed means and said conveyor means.

2. Sheet counting apparatus as defined in claim 1 in which said infeed means has a second infeed roll, said apparatus further including gate means for forming an adjustable gate spacing between said sheet stand and said infeed means, such that only one sheet is permitted to pass therethrough at one time, said gate means comprising:

a. a gate roll rotatably mounted in coaxial relationship to said second infeed roll for joint rotation therewith;

b. a movable plate constituting a part of the bottom of said sheet stand and slidably mounted on a stationary support, said gate spacing being defined between the circumference of said gate roll and the opposed edge of said movable plate;

c. means for constraining said movable plate in movement toward and away from said gate roll relative to said stationary support; and d. means for adjustably coupling said movable plate to said stationary support, whereby said gate spacing is adjustable in accordance with the thickness of each sheet to be counted.

3. Sheet counting apparatus as defined in claim 1 wherein said gate roll has a frictional contact portion formed on at least a part of its circumference to cooperate with said second infeed roll in frictionally carrying the successive sheets away from said sheet stand, and wherein said gate means includes means for maintaining said gate spacing constant in spite of the possible thermal expansion of said frictional contact portion of said gate roll.

4. Sheet counting apparatus as defined in claim 1 further comprising a fault detector switch also mounted on said arm adjacent said other end thereof, said fault detector switch being adapted to be actuated only when at least two sheets travel in superposition over said sending roll.

5. Sheet counting apparatus as defined in claim 1 further including stop motion means for instantly terminating the infeeding operation of the sheets in said sheet stand by said infeed means, said stop motion means comprising:

a. a solenoid having a plunger;

b. at least one arm pivotally mounted forwardly of the sheets in said sheet stand; and c. linkage means operatively connecting said plunger of said solenoid to said arm, whereby, upon energization of said solenoid, said arm is caused to push sheets in said sheet stand backward out of frictional contact with said first and second infeed rolls of said infeed means.

6. Sheet counting apparatus as defined in claim 1 wherein said conveyor means comprises a plurality of parallel spaced endless belts extending in substantially coplanar relationship to each other, and wherein said apparatus further includes a plurality of star wheels rotatably supported in frictional contact with the upper spans of the respective endless belts of said conveyor means adjacent said rear end thereof, said star wheels being effective to raise the trailing edges of the sheets which have been transported to said front end of said conveyor means off the surfaces of said endless belts, thereby permitting each succeeding sheet to be fed under the stack of preceding sheets.

7. Sheet counting apparatus as defined in claim 1 further including adjusting means for transversely varying the position of the sheets in said sheet stand in accordance with their horizontal dimension, said adjusting means comprising:

a. a guide fixedly mounted on a swingable arm and defining one of the lateral edges of said sheet stand;

b. a manually actuable member fixedly mounted on a rotatable shaft for rotating the same to a prescribed angular position in accordance with the size of the sheets to be counted; and c. cam means operatively connecting said rotatable shaft to said swingable arm whereby the position of said guide is adjustable transversely of said sheet stand in accordance with the angular position of said rotatable shaft.

8. Sheet counting apparatus as defined in claim 7 wherein said adjusting means includes means for adjustably varying the position of said abutment of said recovery means in the direction toward and away from said front end of said conveyor means in accordance with the front-to-rear dimension of the sheets to be stacked up thereon, said adjustably varying means comprising:

a. a second swingable arm fixedly supporting said abutment on the free end thereof; and b. second cam means operatively connecting said rotatable shaft to said second swingable arm via linkage means whereby the position of said abutment is adjustable toward and away from said front end of said conveyor means in accordance with the angular position of said rotatable shaft.

* * * * *